US010058735B1

(12) United States Patent
Pan et al.

(10) Patent No.: US 10,058,735 B1
(45) Date of Patent: Aug. 28, 2018

(54) REHABILITATION APPARATUSES, SYSTEMS AND ASSOCIATED METHODS

(71) Applicant: Jingliang Pan, Suzhou (CA)

(72) Inventors: Jingliang Pan, Richmond, CA (US); Wei Yu, Suzhou (CN); Lu Gao, Suzhou (CN)

(73) Assignee: Jingliang Pan, Suzhou (CN)

( * ) Notice: Subject to any disclaimer, the term of this patent is extended or adjusted under 35 U.S.C. 154(b) by 0 days.

(21) Appl. No.: 15/665,110

(22) Filed: Jul. 31, 2017

(30) Foreign Application Priority Data

Feb. 27, 2017 (CN) ..... 2017 1 0106555

(51) Int. Cl.
*A63B 24/00* (2006.01)
*A63B 23/04* (2006.01)
*A63B 23/00* (2006.01)

(52) U.S. Cl.
CPC ..... *A63B 24/0087* (2013.01); *A63B 23/04* (2013.01); *A63B 24/0003* (2013.01); *A63B 2023/006* (2013.01)

(58) Field of Classification Search
CPC ... A63B 24/0087; A63B 24/003; A63B 23/04; A63B 2023/006
See application file for complete search history.

(56) References Cited

U.S. PATENT DOCUMENTS 5,107,822 A 4/1992 Ohashi et al.
5,417,644 A 5/1995 Lee et al.
6,511,447 B1 1/2003 Huang et al.
6,749,539 B2 * 6/2004 Hsieh ..... A61H 1/0237 482/51
7,179,237 B2 2/2007 Elan et al.
7,883,450 B2 * 2/2011 Hidler ..... A61H 3/008 212/104

(Continued)

FOREIGN PATENT DOCUMENTS

CN 2142710 Y 9/1993
CN 2430129 Y 5/2001

(Continued)

OTHER PUBLICATIONS

International Search Report and Written Opinion in International Application No. PCT/CN2017/100923, dated Dec. 8, 2017, 14 pages.

*Primary Examiner* — Glenn Richman
(74) *Attorney, Agent, or Firm* — Perkins Coie LLP

(57) ABSTRACT

Apparatuses for moving or stretching a body portion of a user and associated methods are disclosed herein. The apparatus includes (1) a supporting element configured to support the body portion; (2) a first rod configured to selectively move the supporting element in a first direction and in a second direction; (3) a first shaft coupled to the first rod; (4) a first motor coupled to and configured to rotate the first shaft; (5) a second rod configured to selectively move the supporting element in a third direction; (6) a second shaft coupled to the second rod; and (7) a second motor coupled to and configured to rotate the second shaft. The first direction and the second directions together define a reference plane generally perpendicular to the third direction. The supporting element can be moved by the first and second rods along a three-dimensional moving trajectory.

20 Claims, 11 Drawing Sheets

(56) References Cited

U.S. PATENT DOCUMENTS

| | | | | |
|---|---|---|---|---|
| 8,444,580 | B2 * | 5/2013 | Ochi | A61H 1/005 482/70 |
| 9,717,952 | B2 * | 8/2017 | Bird | A63B 21/0058 |
| 9,844,692 | B2 * | 12/2017 | Rollins | A63B 21/0058 |
| 2009/0082704 | A1 | 3/2009 | Nov et al. | |

FOREIGN PATENT DOCUMENTS

| | | | |
|---|---|---|---|
| CN | 1437459 | A | 8/2003 |
| CN | 202724203 | U | 2/2013 |
| CN | 106924009 | A | 7/2017 |

* cited by examiner

REHABILITATION APPARATUSES, SYSTEMS AND ASSOCIATED METHODS

RELATED APPLICATIONS

This patent document claims priority to Chinese patent application No. CN201710106555.8 filed on Feb. 27, 2017. The entire contents of the before mentioned patent application is incorporated by reference in this patent document.

TECHNICAL FIELD

The present technology is directed generally to apparatuses, systems and associated methods for stretching, moving, and/or rotating a portion of a human body. More particularly, the present technology relates to an apparatus for moving and/or rotating a lower body (e.g., legs) of a human being such that another body part (e.g., lumbar vertebrae) of the human can be stretched.

BACKGROUND

In recent years, due to various reasons such as long-hour sitting on an office chair or lack of sufficient activities, more and more people suffer from back pains or other similar symptoms. Back pains can significantly impact people's daily lives and lower their life qualities. Traditional approaches to relieve such pains may include physical therapies or chiropractic or medical treatments. Some of these therapies or treatments can only be performed in certain facilities and/or by trained professionals and therefore can be expensive, time-consuming, or inconvenient. For example, a patient may need to spend an hour driving to a hospital for these pain-relief treatments, and sitting in a vehicle for an hour could be a painful process for the patient. Therefore, it is advantageous to have an improved apparatus, systems and methods to address the above-mentioned problems.

SUMMARY

The following summary is provided for the convenience of the reader and identifies several representative embodiments of the disclosed technology. Generally speaking, the present technology provides improved apparatuses, systems and methods for moving or rotating a body portion (e.g., a leg, a lower body, a foot, a lower back, etc.) of a user so as to stretch the body portion (or another body portion) and then relieve the user from the pains or discomfort suffered. More particularly, the present technology provides an apparatus configured to move and/or rotate legs of a user along a three-dimensional trajectory determined based on physical conditions of the user and/or other information provided by the user (e.g., user preferences). For example, the present technology can receive (e.g., via a mobile device carried by the user) information indicating that a user is suffering from lower back pain and has scoliosis symptoms. The present technology can then determine the three-dimensional trajectory based on the received information (e.g., select it from a list of candidate trajectories stored in a database or calculate it based on the received information). By this arrangement, the present technology provides the user a convenient, effective way to stretch his/her body portion.

In representative embodiments, an apparatus in accordance with the present technology includes, for example, (1) a supporting element (e.g., a leg resting pad) configured to support a body portion; (2) a first rod configured to selectively move the supporting element in a first direction and/or in a second direction; (3) a first crankshaft coupled to the first rod; (4) a first speed reducer coupled to and configured to rotate the first crankshaft so as to facilitate moving the first rod in the first and/or second directions; (5) a first motor coupled to the first speed reducer and configured to rotate the first crankshaft; (6) a second rod configured to selectively move the supporting element, at least partially, in a third direction; (7) a second crankshaft coupled to the second rod; (8) a second speed reducer coupled to and configured to rotate the second crankshaft so as to facilitate moving the second rod, at least partially, in the third direction; and (9) a second motor coupled to the second speed reducer and configured to rotate the second crankshaft. The first direction and the second direction together define a reference plane generally perpendicular to the third direction. The apparatus enables the user to move his/her body portion along a three-dimensional moving trajectory by moving the first and second rods.

Another aspect of the present technology is to provide a method for moving a body portion of a user by a supporting element along a three-dimensional trajectory. In some embodiments, the method includes, for example, (1) receiving, from a user mobile device, a set of user information; (2) determining the three-dimensional moving trajectory at least based in part on the received user information; (3) positioning the body portion of the user on the supporting element; (4) moving, based on the determined three-dimensional moving trajectory, the supporting element by a first rod coupled to the supporting element in a first direction and/or in a second direction; and (5) moving, based on the determined three-dimensional moving trajectory, the supporting element by a second rod coupled to the supporting element, at least partially, in a third direction. The first direction and the second direction together define a reference plane generally perpendicular to the third direction. By this arrangement, the supporting element can be moved in the first, second and third directions by the first and second rods along the three-dimensional moving trajectory.

Yet another aspect of the present technology is to provide a system for moving a body portion of a user. The system includes, for example, (1) a processor; (2) a memory coupled to the processor; (3) a data storage coupled to the processor and configured to store information associated with a plurality of three dimensional candidate trajectories corresponding to a plurality of treatments for the user; (4) a user interface (e.g., a display) coupled to the processor and configured to receive user information; (5) a supporting element configured to support the body portion; (6) a first rod configured to selectively move the supporting element in a first direction and in a second direction; (7) a first crankshaft coupled to the first rod; (8) a first motor coupled and configured to rotate the first crankshaft; (9) a second rod configured to selectively move the supporting element in a third direction; (10) a second crankshaft coupled to the second rod; and (11) a second motor coupled and configured to rotate the second crankshaft. The processor determines, based on the user information, a three-dimensional moving trajectory (e.g., select from stored three dimensional candidate trajectories or calculate one). The first direction and the second direction together define a reference plane generally perpendicular to the third direction. By this arrangement, the supporting element can be moved in the first, second and third directions by the first and second rods along the three-dimensional moving trajectory. In some embodiments, the movements of the first and second rods can be controlled by a mobile device of the user (e.g., via an application or app).

Apparatuses, systems and methods in accordance with embodiments of the present technology can include any one or a combination of any of the elements described herein.

DETAILED DESCRIPTION

The present technology is directed generally to apparatuses, systems and associated methods for moving (e.g., translating and/or rotating) a body portion of a user. Embodiments of the present technology are discussed in detail below. Several details describing structures or processes that are well-known and corresponding systems and subsystems, but that may unnecessarily obscure some significant aspects of the disclosed technology, are not set forth in the following description for purposes of clarity. Moreover, although the following disclosure sets forth several embodiments of different aspects of the technology, several other embodiments can have different configurations and/or different components than those described in this section. Accordingly, the technology may have other embodiments with additional elements and/or without several of the elements described below with reference to FIGS. 1-10. FIGS. 1-10 are provided to illustrate representative embodiments of the disclosed technology. Unless provided for otherwise, the drawings are not intended to limit the scope of the claims in the present application.

Figure 1A:
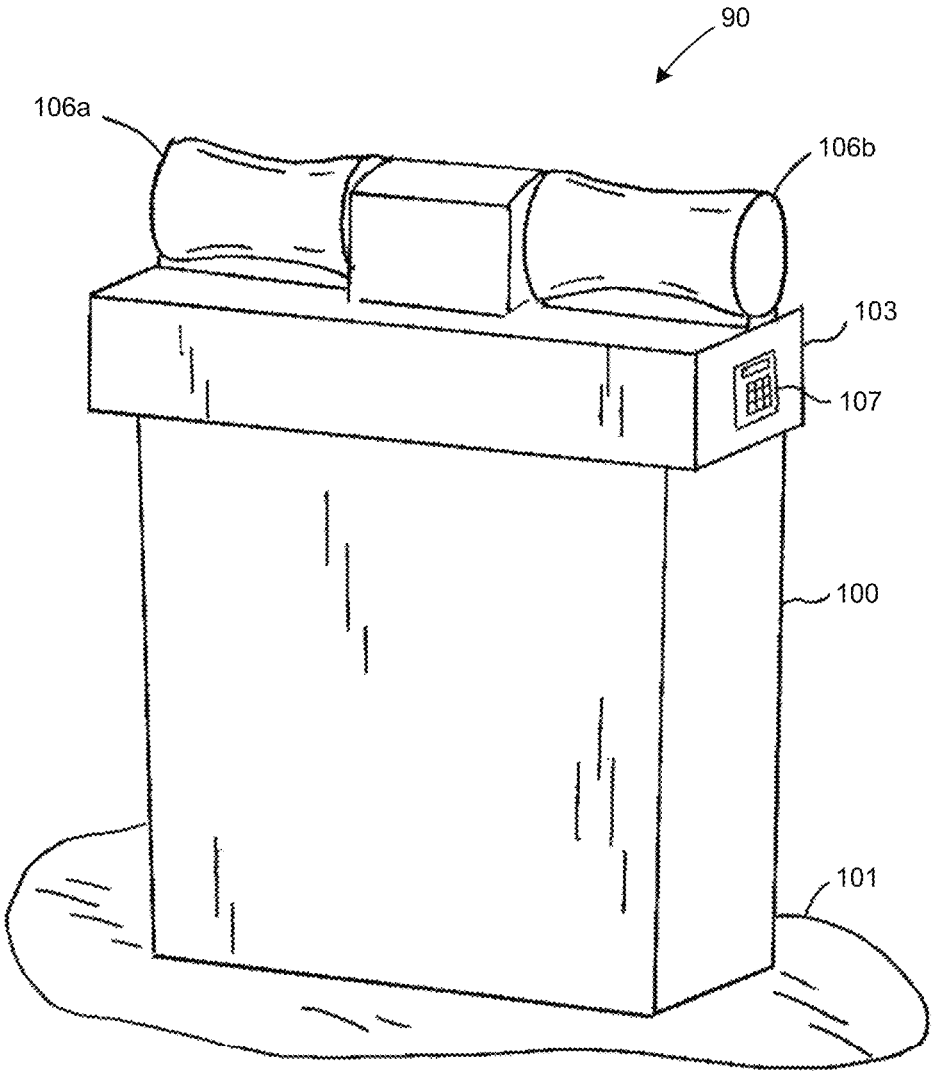
FIG. 1A is an isometric view of a system configured in accordance with representative embodiments of the disclosed technology.

FIG. 1A is an isometric view of a system 90 for moving a portion of a user's body in accordance with representative embodiments of the disclosed technology. The system 90 includes an apparatus 100 and a support assembly or member 103 ("supporting member 103"). The apparatus 100 is configured to the supporting member 103 to perform physical therapies, chiropractic treatments, medical treatments, or other procedures. The supporting member 103 can include one or more support elements 106*a*, 106*b* configured to support a user's body. For example, the user's legs can rest on the support elements 106*a*, 106*b* while the apparatus 100 translates, rotates, vibrates, or otherwise drives the supporting member 103. The contoured surfaces of the support elements 106*a*, 106*b* can comfortably support the user's ankle, calves, arms, or other body part to be moved. In some procedures, the support elements 106*a*, 106*b* move the user's legs relative to the user's torso to stretch the user's back.

The apparatus 100 can include a computing device (e.g., including one or more analysis components) for determining a three-dimensional path or trajectory for moving the supporting element 103 and a controller 107 for controlling one or more motors to move the supporting element 103 according to the three-dimensional trajectory. The apparatus 100 can include speed adjustors (e.g., speed reducers), bearings, actuators, power sources, or the like to provide the desired motion (e.g., reciprocating motion), degrees of freedom (e.g., 2, 3, 4, 5, or 6 degrees of freedom), and/or determined three-dimensional trajectories, which may include one or more linear paths, non-linear paths (e.g., arcuate paths, elliptical paths, etc.), or combinations thereof.

Figure 1B:
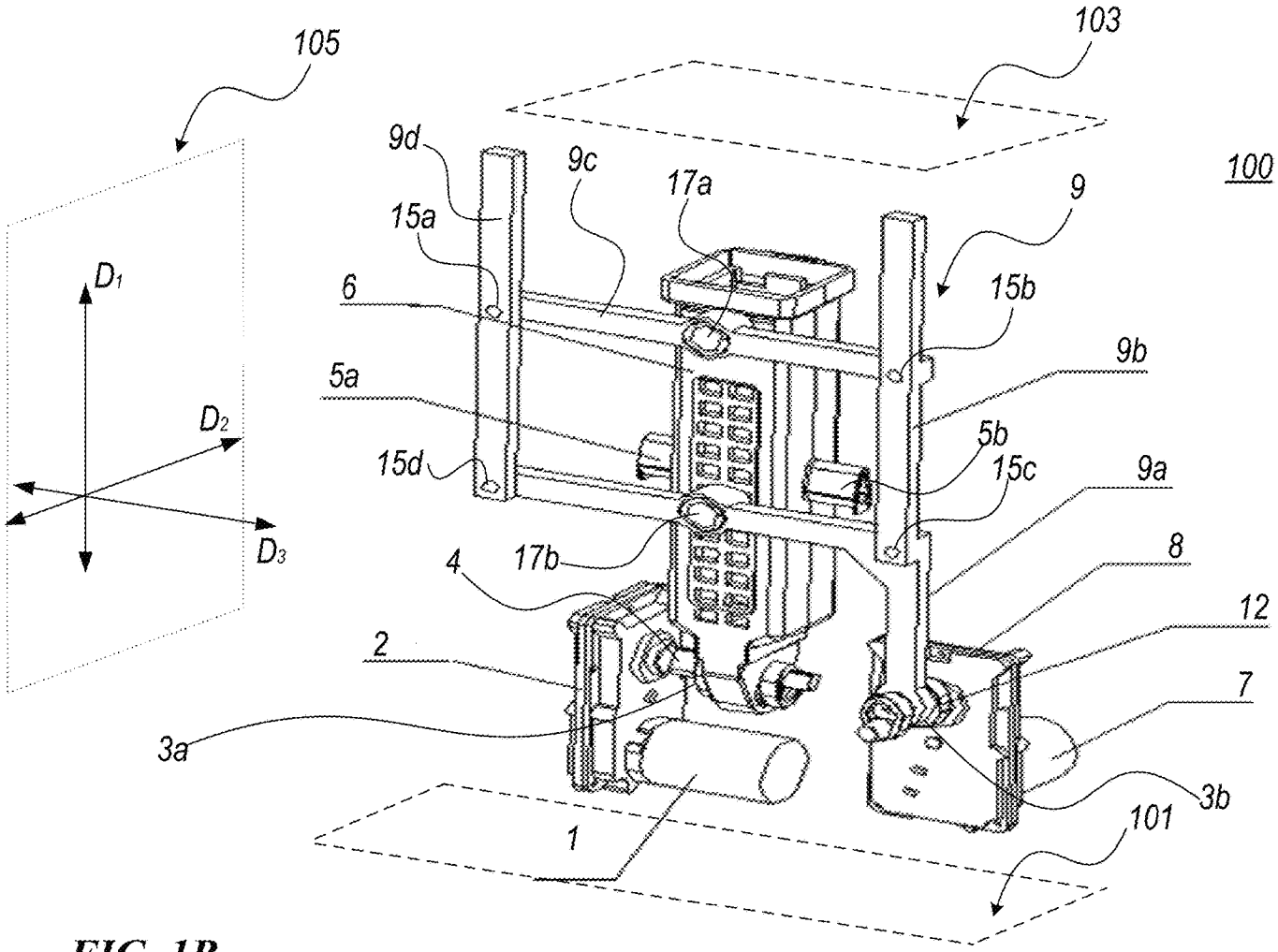
FIG. 1B is an isometric view of an apparatus configured in accordance with representative embodiments of the disclosed technology.

FIG. 1B is an isometric view of an apparatus 100 configured in accordance with representative embodiments of the disclosed technology. As shown in FIG. 1, the apparatus 100 includes a first motor 1, a first speed reducer 2 coupled to the first motor 1, a first driveshaft or crankshaft 4 ("first crankshaft 4") coupled to the first speed reducer 2, a first rod assembly 6 coupled to the first crankshaft 4 via a first crankshaft bearing 3*a*, a second motor 7, a second speed reducer 8 coupled to the second motor 7, a second driveshaft or crankshaft 12 ("second crankshaft 12") coupled to the second speed reducer 8, and a second rod assembly 9 coupled to the second crankshaft 12 via a second crankshaft bearing 3*b*. As shown, the first rod assembly 6 includes protrusions 5*a*, 5*b* positioned on both sides. The protrusions 5*a*, 5*b* are configured to guide or limit the movement of the first rod assembly 6 by cooperating with corresponding guiding elements (to be discussed in detail below with reference to FIG. 2 and FIG. 9). The first crankshaft bearing 3*a* is configured to facilitate the rotation between the first crankshaft 4 and the first rod assembly 6. Similarly, the second crankshaft bearing 3*b* is configured to facilitate the rotation between the second crankshaft 12 and the second rod assembly 9.

As shown, the second rod assembly 9 includes a first linking member 9*a*, a second linking member 9*b*, a third linking member 9*c*, and a fourth linking member 9*d*. In some embodiments, the first linking member 9*a* can be two straight linking members that are operably coupled together. The second rod assembly 9 can include one or more pivots 15*a*, 15*b*, 15*c*, 15*b* and one or more pivots 17*a*, 17*b*. The pivots 15*a*, 15*b*, 15*c*, 15*b* can cooperate to allow reconfiguration of the second rod assembly 9. The pivots 17*a*, 17*b* can rotatably couple the first rod assembly 6 to the second rod assembly 9. The number and positions of the pivots can be selected based on the configuration of the second rod assembly 9 and desired motion type and/or motion range. The second rod assembly 9 is to be discussed in detail with reference to FIG. 2 below.

As shown, the apparatus 100 further includes a supporting member 103 coupled to the first rod assembly 6 and the second rod assembly 9. The supporting member 103 can be moved or rotated, directly or indirectly, by the first rod assembly 6 (e.g., in first and second directions $D_1$, $D_2$) and by the second rod assembly 9 (e.g., at least partially in a third direction $D_3$). The supporting member 103 is also configured to support and move/rotate a body portion (e.g., legs) of a user. Accordingly, the apparatus 100 can move the body portion of the user along a three-dimensional trajectory (e.g., a trajectory in a space defined by $D_1$, $D_2$, and $D_3$) by operating the first rod assembly 6 and the second rod assembly 9.

In some embodiments, the apparatus 100 can further include a chassis (not shown in FIG. 1) configured to connect and/or support other elements (e.g., first/second motors 1, 7, first/second speed reducers 2, 8, etc.) of the apparatus 100. In some embodiments, the apparatus 100 can be positioned on a floor surface 101 during operation. In such embodiments, the apparatus 100 can be securely positioned on the floor surface 101. In some embodiments, the apparatus 100 can include a housing (not shown) configured to cover the elements of the apparatus 100.

When the first motor 1 rotates, the first speed reducer 2 accordingly rotates the first crankshaft 4 at a different, lower speed. When the first crankshaft 4 rotates, the first rod assembly 6 can be moved in the first direction $D_1$ (e.g., upward/downward direction) and/or in the second direction $D_2$ (e.g., forward/backward direction). As shown in FIG. 1, the first and second directions together define a reference plane 105. Therefore, by moving the first rod assembly 6, the supporting element 103 can be moved along a two-dimensional trajectory (e.g., a two-dimensional ellipse) on the reference plane 105.

By operating the second rod assembly 9, the present technology can further move the supporting element 103, at least partially, in the third direction $D_3$ (e.g., left/right direction) generally perpendicular (e.g., within a threshold degree of tilting deviation such as 5, 10, or 20 degrees) to the reference plane 105. More particularly, when the second motor 7 rotates, the second speed reducer 8 accordingly rotates the second crankshaft 12 at a different, lower speed. When the second crankshaft 12 rotates, the second rod assembly 9 can be moved in the third direction $D_3$. In some embodiments, the second rod assembly (or a portion thereof) can be moved partially in the third direction $D_3$ and partially in the first direction $D_1$. By the arrangement of at least the first crankshaft 4, the first rod assembly 6, the second crankshaft 12, and the second rod assembly 9, the supporting element 103 (or a portion thereof) can be moved along a three-dimensional trajectory (e.g., a trajectory on the surface of a three-dimensional ellipsoid), which provides better flexibility and moving potential than does a two-dimensional trajectory.

In some embodiments, the first speed reducer 2 or the second speed reducer 8 can be a 4-step speed reducer that is capable of reducing the rotational speed of a motor (e.g., the first motor 1 or the second motor 7) to four different, lower speeds. In some embodiments, the first speed reducer 2 or the second speed reducer 8 can include multiple gears, such as spur gears, helical gears, worm gears, beveled gears, and/or planetary gears. In some embodiments, by using different types/numbers of gears, the first speed reducer 2 or the second speed reducer 8 can reduce the rotational speed of a motor to various different, lower speeds.

Figure 2:
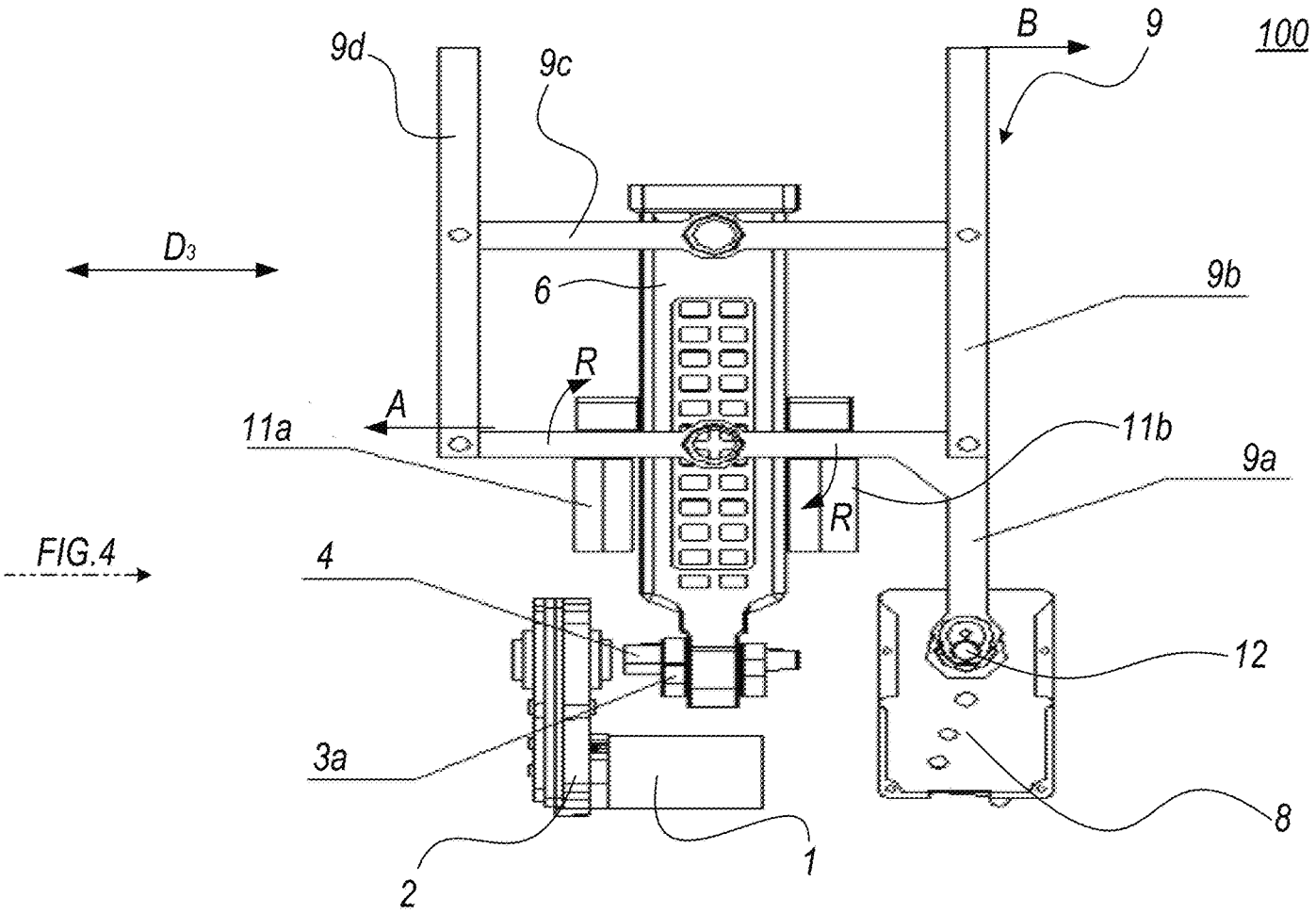
FIG. 2 is a side view of an apparatus configured in accordance with representative embodiments of the disclosed technology.

FIG. 2 is a side view of the apparatus 100 configured in accordance with representative embodiments of the disclosed technology. As shown, the first linking member 9*a* is L-shaped and directly coupled to the second crankshaft 12 and the first rod assembly 6. In some embodiments, the first linking member 9*a* can be named as an active linking member (e.g., directly connected to the second crankshaft 12). The first linking member 9*a* is coupled to the first rod assembly 6. When the second crankshaft 12 rotates, the first linking member 9*a* can be moved, at least partially, in the third direction $D_3$, and accordingly the first rod assembly 6 can be moved, at least partially, in the third direction $D_3$.

As shown, the second linking member 9*b* is operably coupled to the first linking member 9*a*. In some embodiments, the second linking member 9*b* can be further coupled to the supporting element 103. The second linking member 9*b* is indirectly coupled to the second crankshaft 12 by the first linking member 9*a* and accordingly can be moved by the first linking member 9*a*. The third linking member 9*c* is indirectly coupled to the second crankshaft 12 by the first and second linking members 9*a*, 9*b* and directly coupled to the first rod assembly 6. The fourth linking member 9*d* is indirectly coupled to the second crankshaft 12 by the first linking member 9*a*. The fourth linking member 9*d* is also operably coupled to the third linking member 9*c* (e.g., for structure rigidity of the second rod assembly 6). In some embodiments, the second/third/fourth linking members 9*b*, 9*c*, 9*d* can be named as passive linking members (e.g., indirectly connected to the second crankshaft 12).

In FIG. 2, the protrusions 5*a*, 5*b* (FIG. 1B) are positioned in guiding elements 11*a*, 11*b* (not shown in FIG. 1B), respectively. The guiding elements 11*a*, 11*b* are configured to guide or restraint the movement of the first rod assembly 6. For example, in the embodiments shown in FIG. 2, when the first linking member 9*a* is moved, at least partially, in direction A, the guiding element 11*a* then stops the first rod assembly 6 from moving beyond it in direction A. When the first rod assembly 6 is stopped in direction A, the first linking member 9*a* can rotate in direction R. As a result, the end of the second linking member 9*b* (and/or the end of the fourth linking member 9*d*) that is coupled to the supporting member 103 can be moved, at least partially, in direction B and accordingly the supporting member 103 is moved, at least partially, in the same direction B. By this arrangement, the apparatus 100 can move the supporting member 103, at least partially, in the third direction $D_3$. The range of the movement in the third direction $D_3$ can vary depending on relative locations of the guiding elements 11*a*, 11*b* and the first rod assembly 6, and the size, length, and/or orientation of the linking members 9*a*-9*d*.

Figure 3:
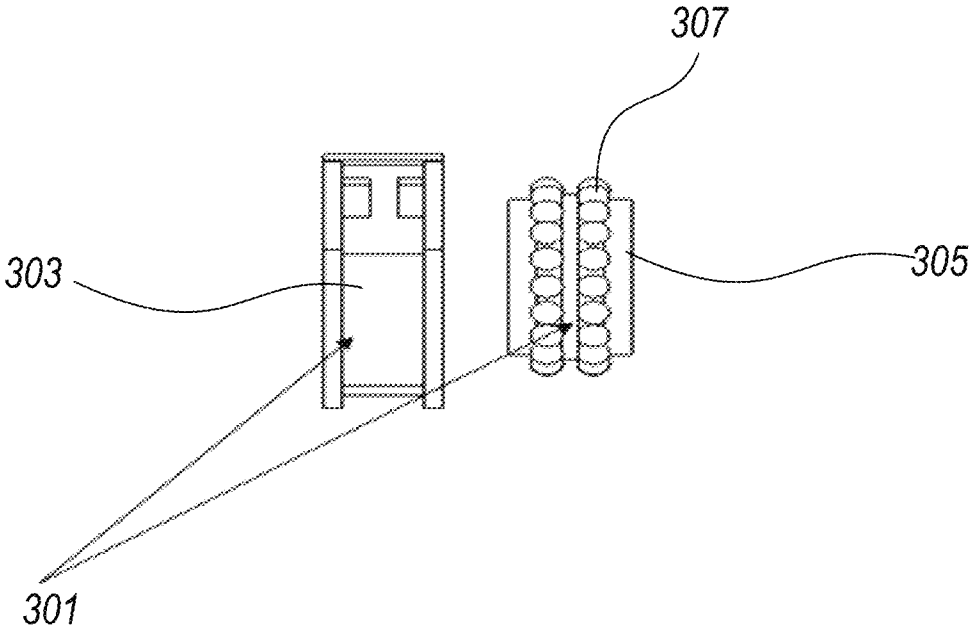
FIG. 3 is a schematic diagram illustrating the connection between a crankshaft and a speed reducer in accordance with representative embodiments of the disclosed technology.

FIG. 3 is a schematic diagram illustrating the connection between a shaft and a speed reducer in accordance with representative embodiments of the disclosed technology. As shown, a bearing assembly 301 can be configured to couple a shaft (e.g., the first crankshaft 4 or the second crankshaft 12) to a rod assembly (e.g., the first rod assembly 6 or the second rod assembly 9). The bearing assembly 301 can include an external portion 303 and an internal portion 305 positioned inside the external portion 303. A plurality of rollers 307 can be positioned between the external portion 303 and the internal portion 305. The bearing assembly 301 is configured to facilitate the relative rotation between the shaft and a motor (e.g., the first motor 1 or the second motor 7) or a motor speed reducer (e.g., the first speed reducer 2 or the second speed reducer 8) coupled thereto. In some embodiments, the shaft can be coupled to the internal portion 305. In other embodiments, however, the shaft can be coupled to the external portion 303.

Figure 4:
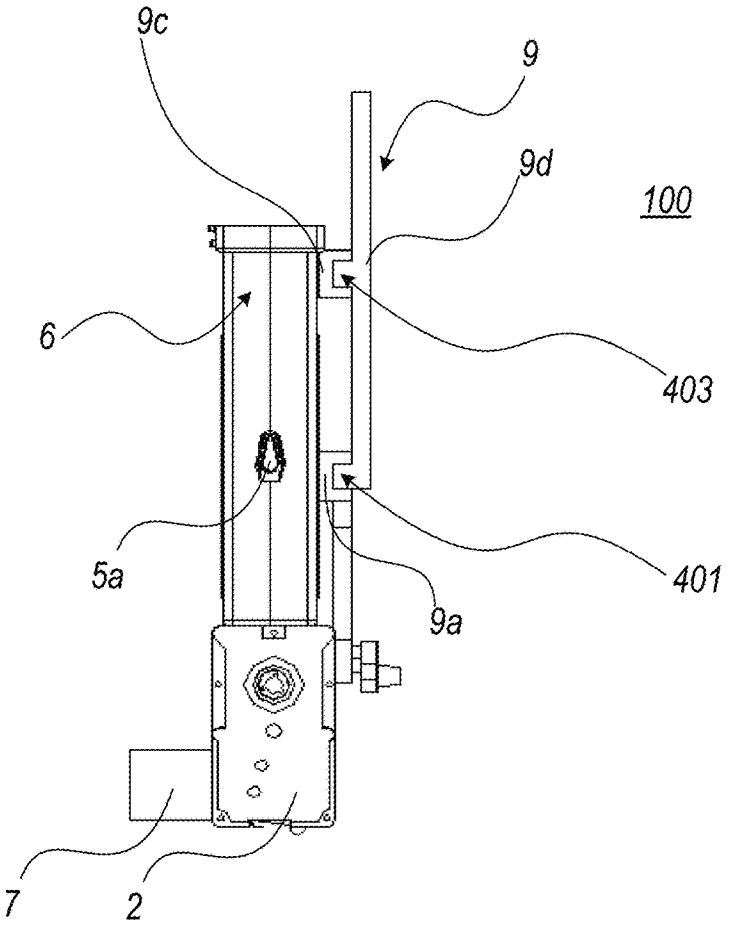
FIG. 4 is a schematic side view of an apparatus configured in accordance with representative embodiments of the disclosed technology.

FIG. 4 is a schematic side view of the apparatus 100 configured in accordance with representative embodiments of the disclosed technology. In the illustrated embodiments, the first linking member 9*a* can have a first recess 401 configured to accommodate the fourth linking member 9*d*. Similarly, the third linking member 9*c* can have a second recess 403 configured to accommodate the fourth linking member 9*d*. The first recess 401 and the second recess 403 enable the fourth linking member 9*d* to be operably (e.g., rotatably) coupled to the first linking member 9*a* and the third linking member 9*c*.

Figure 5:
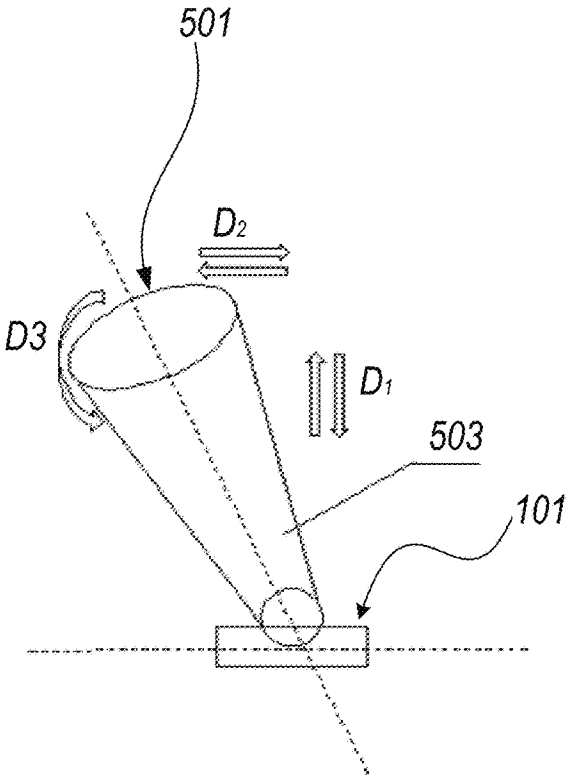
FIG. 5 is a schematic diagram illustrating a three-dimensional trajectory in accordance with representative embodiments of the disclosed technology.

FIG. 5 is a schematic diagram illustrating a three-dimensional trajectory 501 in accordance with representative embodiments of the disclosed technology. As shown in FIG. 5, the apparatus 100 can move at least a portion of the supporting member 103 along the three-dimensional trajectory 501 in a three-dimensional space defined by the first, second, and third directions $D_1$, $D_2$, and $D_3$. Observing from the floor surface 101 where the apparatus 100 is positioned, the three-dimensional trajectory 501 can be any trajectory in a conical space 503. The size of the conical space 503 can be determined by the ranges of the movement of the first rod assembly 6 and the second rod assembly 9. The configuration, sizes, and components of the apparatus 100 can be selected based on the desired three-dimensional trajectory 501. For example, the bearings 3*a*, 3*b* can include crankpins configured to convert rotational motion of the crankshafts 4, 12, respectively, to desired reciprocating motion of the rod assembly 6. In other embodiments, the bearings 3*a*, 3*b* can include bearing races, ball bearings, cams and/or followers, or other features for providing desired motion of the rod assembly 6.

Figure 6:
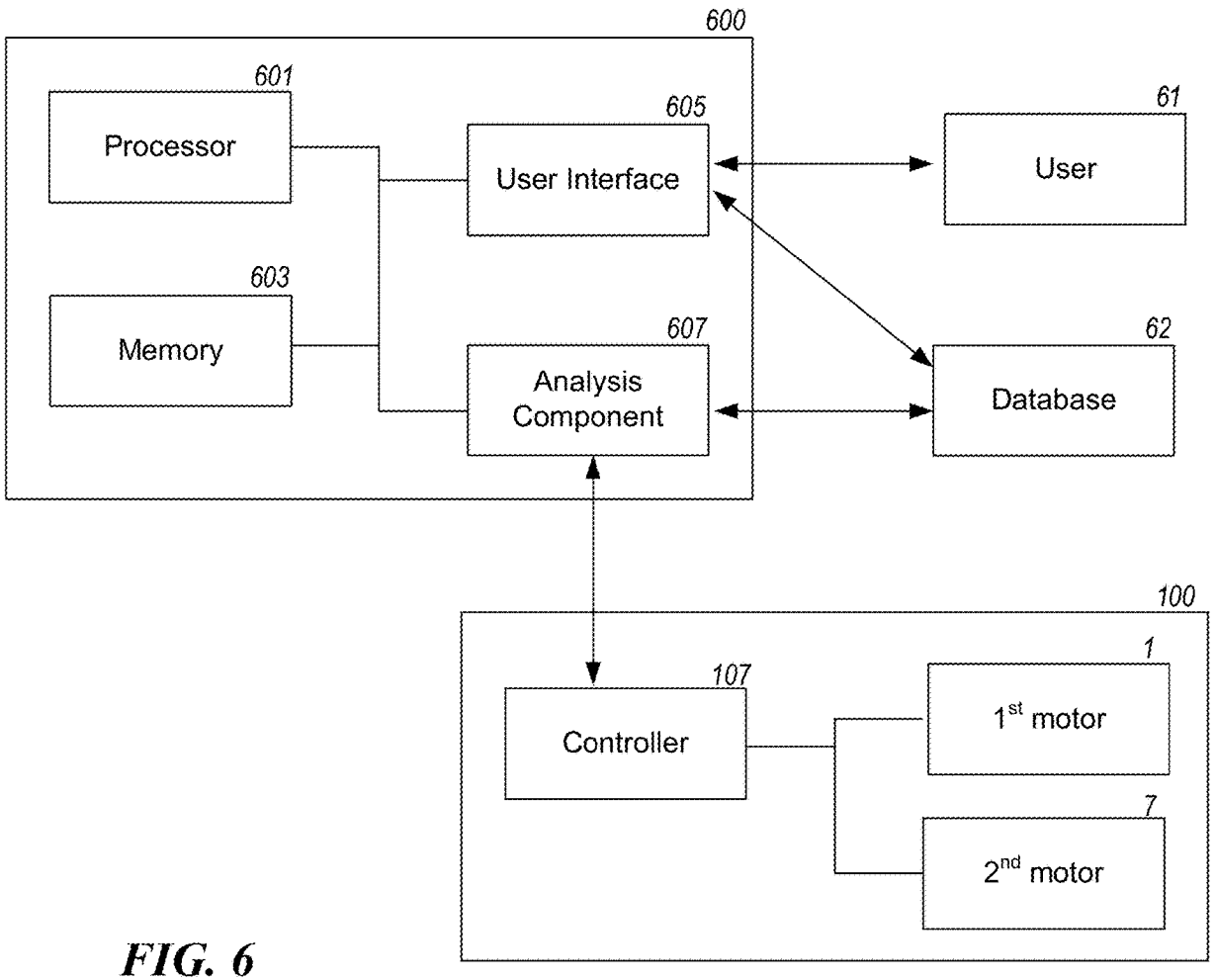
FIG. 6 is a schematic block diagram illustrating a system in accordance with representative embodiments of the disclosed technology.

FIG. 6 is a schematic block diagram illustrating a system 600 in accordance with representative embodiments of the disclosed technology. The system 600 includes one or more processors 601, a memory 603 coupled to the processor(s) 601, a user interface 605, and an analysis component 607. In some embodiments, the user interface 605 can include a display, a touch screen, a keypad, etc. In some embodiments, the analysis component 607 can be implemented as a software application, an app, a hardware component with corresponding instructions thereon, etc. In some embodiments, the system 600 can include a portable device such as a smartphone, a wearable device, or a notebook. The system 600 is configured to determine how to operate the apparatus 100. More particularly, the system 600 is configured to determine a three-dimensional trajectory 501 and control the apparatus 100 to move the supporting member 103 (or a portion thereof) along the determined trajectory 501. In some embodiments, the system 600 can be implemented as a component of the apparatus 100.

First, the system 600 can receive a set of user information from a user 61 via the user interface 605. Examples of the user information include: gender, age, height, weight, expected time to operate the apparatus 100, and/or a "pain level." The "pain level" information can be further described by the following factors: locations of the pain (e.g., neck pain, lower back pain, or lower body pain), types of the pain (e.g., at a point, in an area, etc.), particular feelings (e.g., numbness, abnormality, etc.), statuses of muscles (e.g., paralyzed, normal, sore, etc.), statuses of a spine (e.g., normal, curvature, shapes, etc.), and/or user's mobility status (e.g., normal, crippled, etc.).

After the system 600 receives the user information, the analysis component 607 can then determine how to operate the apparatus 100. More particularly, the analysis component 607 can determine the three-dimensional trajectory 501 for moving the supporting element 103 of the apparatus 100 and control the first and second motors 1, 7 via a controller 107 to achieve the determined three-dimensional trajectory 501. Illustratively, the analysis component 607 can generate operating instructions in accordance with the determined three-dimensional trajectory 501 and transmit the operating instructions to the controller 107. The controller 107 is coupled to the first and second motors 1, 7 and configured to receive the operating instructions and control the timing (e.g., to start, pause, or end operation), speed (e.g., constant, varied, randomized, or a combination of the two), and/or other functionalities of the first motor 1 and the second motor 7, respectively, in accordance with the operating instructions, to achieve the three-dimensional trajectory 501.

In some embodiments, the analysis component 607 can access a remote database 62 (or a local database in the system 600) to retrieve a plurality of candidate trajectories and then select one or more suitable trajectories from the candidate trajectories based on the received user information. In some embodiments, the analysis component 607 can further modify the selected one or more trajectories based on the received user information. In some embodiments, the analysis component 607 can calculate or generate a suitable trajectory by applying a set of predetermined rules on the received user information (e.g., move the user's legs in the third direction $D_3$ back and forth for 10 minutes if the user information indicates that the user has a lower back pain; and/or move the user's legs in the second direction $D_2$ if the user information indicates that the user has a minor spine pain; and/or move the user's legs in the first direction $D_1$ if the user information indicates that the user wants to stretch his/her glutes).

In some embodiments, the candidate trajectories can be categorized into several categories or modes, such as a light-stretching mode, a heavy-stretching mode, a rehabilitation mode (e.g., for specific types of pain or symptoms), etc. In some embodiments, the analysis component 607 can determine to repeatedly operate the apparatus 100 for a certain period of time (e.g., 15 minutes) or along the determined trajectory several times (e.g., 10 times).

In some embodiments, the trajectory calculated, generated, or modified by the analysis component 607 can be uploaded to a database (e.g., the database 62) and/or stored in cloud for future reference or use. In some embodiments, the system 600 and the apparatus 100 can communicate via a wireless communication such as Bluetooth, Wi-Fi, 3G/4G, or other suitable communications.

Figure 7:
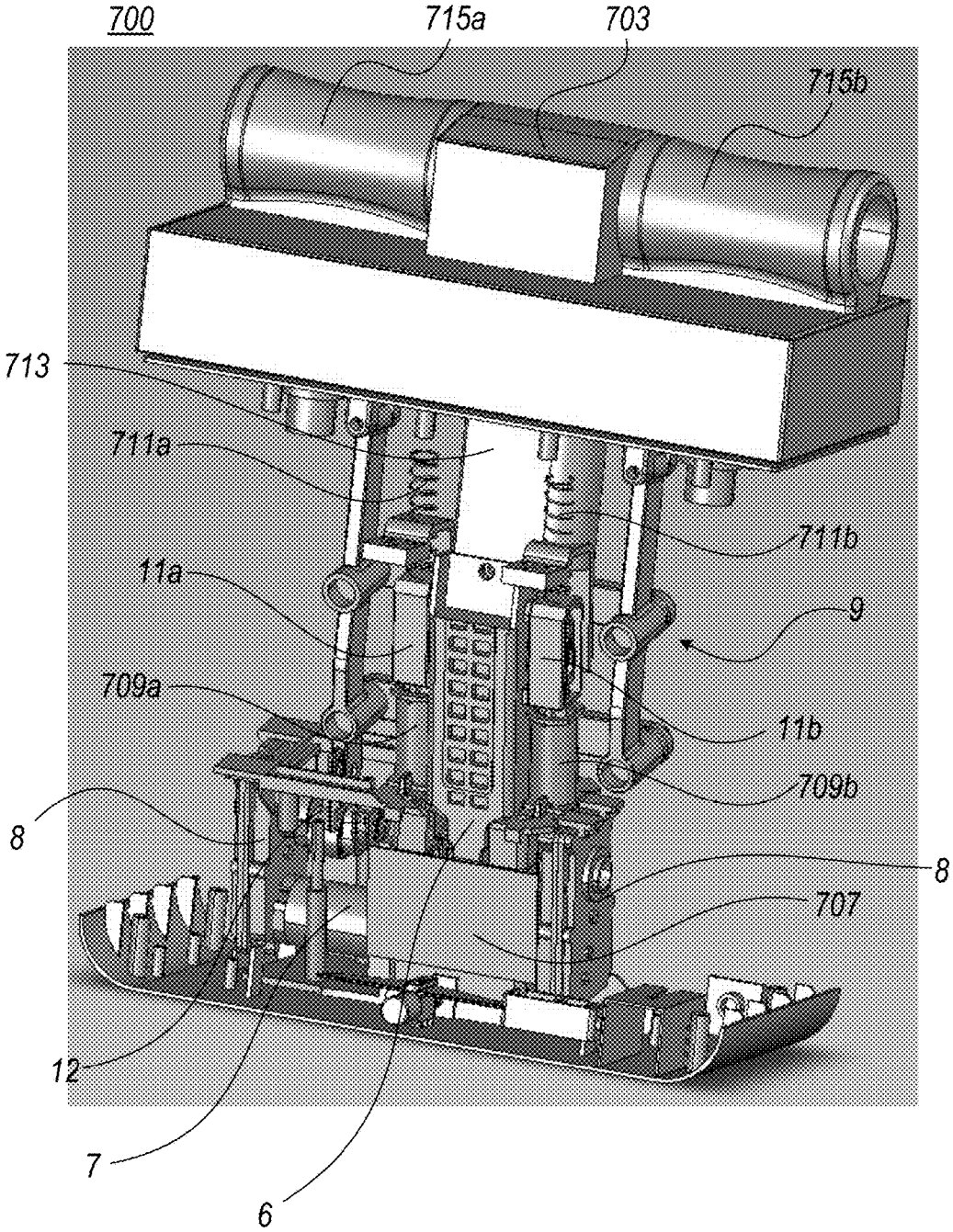
FIG. 7 is a front isometric view of an apparatus configured in accordance with representative embodiments of the disclosed technology.
Figure 8:
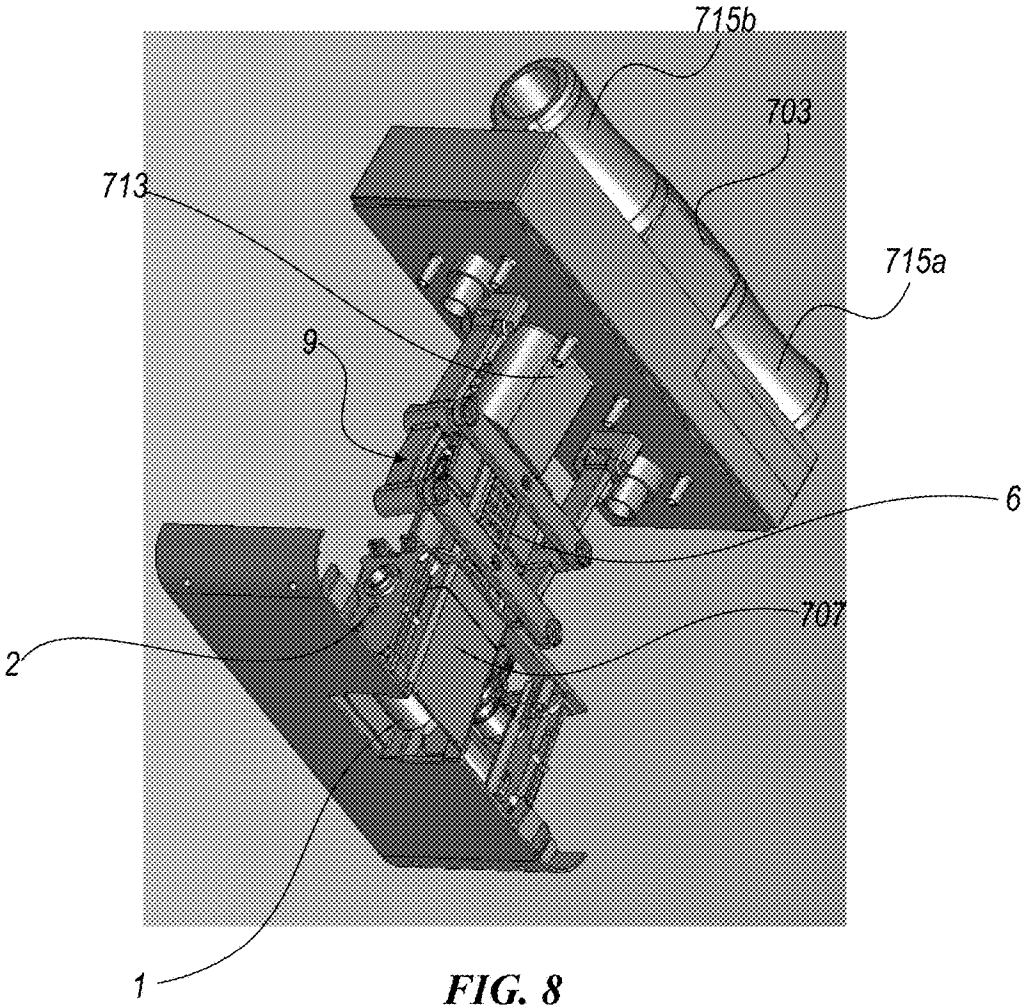
FIG. 8 is a back isometric view of an apparatus configured in accordance with representative embodiments of the disclosed technology.

FIGS. 7 and 8 are front and back isometric views of an apparatus 700 configured in accordance with representative embodiments of the disclosed technology. The apparatus 700 includes a first rod assembly 6 and a second rod assembly 9 configured to move a supporting element 703 along a three-dimensional trajectory. In the illustrated embodiments, the first rod assembly 6 is coupled to the supporting element 703 via a connecting component 713. The second rod assembly 9, on the other hand, is directly coupled to the supporting element 703. In other embodiments, the first and second rod assemblies can be coupled to the supporting element 703 by other suitable means.

As shown in FIG. 7, the supporting element 703 includes two rest portions 715*a*, 715*b* configured to support the legs of a user and move/rotate them along the three-dimensional trajectory. The first rod assembly 6 can be driven by a first motor 1 (FIG. 8) via a first speed reducer 2 (FIG. 8) and a first crankshaft (not shown). The second rod assembly 6 can be driven by a second motor 7 via a second speed reducer 8 and a second crankshaft 12. The apparatus 700 also includes a chassis 707 configured to support the first and second motors 1, 7 and/or the first and second speed reducer 2, 8. The chassis 707 can be securely positioned on a floor surface such that the apparatus 700 is not moved relative to the floor surface during operation.

In the illustrated embodiments in FIGS. 7 and 8, the apparatus 700 includes (1) a first adjusting component 709*a* (e.g., a hydraulic piston, etc.) coupled to a first guiding element 11*a* and (2) a second adjusting component 709*b* coupled to a second guiding element 11*b*. The first and second guiding elements 11*a*, 11*b* are configured to guide or restraint the movement of the first rod assembly 6. The first and second adjusting components 709*a*, 709*b* are configured to adjust the locations of the first and second guiding elements 11*a*, 11*b*, respectively. By adjusting the locations of the first and second guiding elements 11*a*, 11*b*, the apparatus 700 can move the first rod assembly 6 (and therefore the supporting element 703) in various ranges.

As shown, the apparatus 700 includes a first resilient member 711*a* coupled to the first guiding member 11*a* and positioned opposite to the first adjusting component 709*a*. The first resilient member 711*a* is configured to maintain the position of the first guiding member 11*a* and/or stabilize the same. Similarly, a second resilient member 711*b* is coupled to the second guiding member 11*b* and positioned opposite to the second adjusting component 709*b*. The second resilient member 711*b* can function in the ways similar to those of the first resilient member 711*a* mentioned above.

Figure 9:
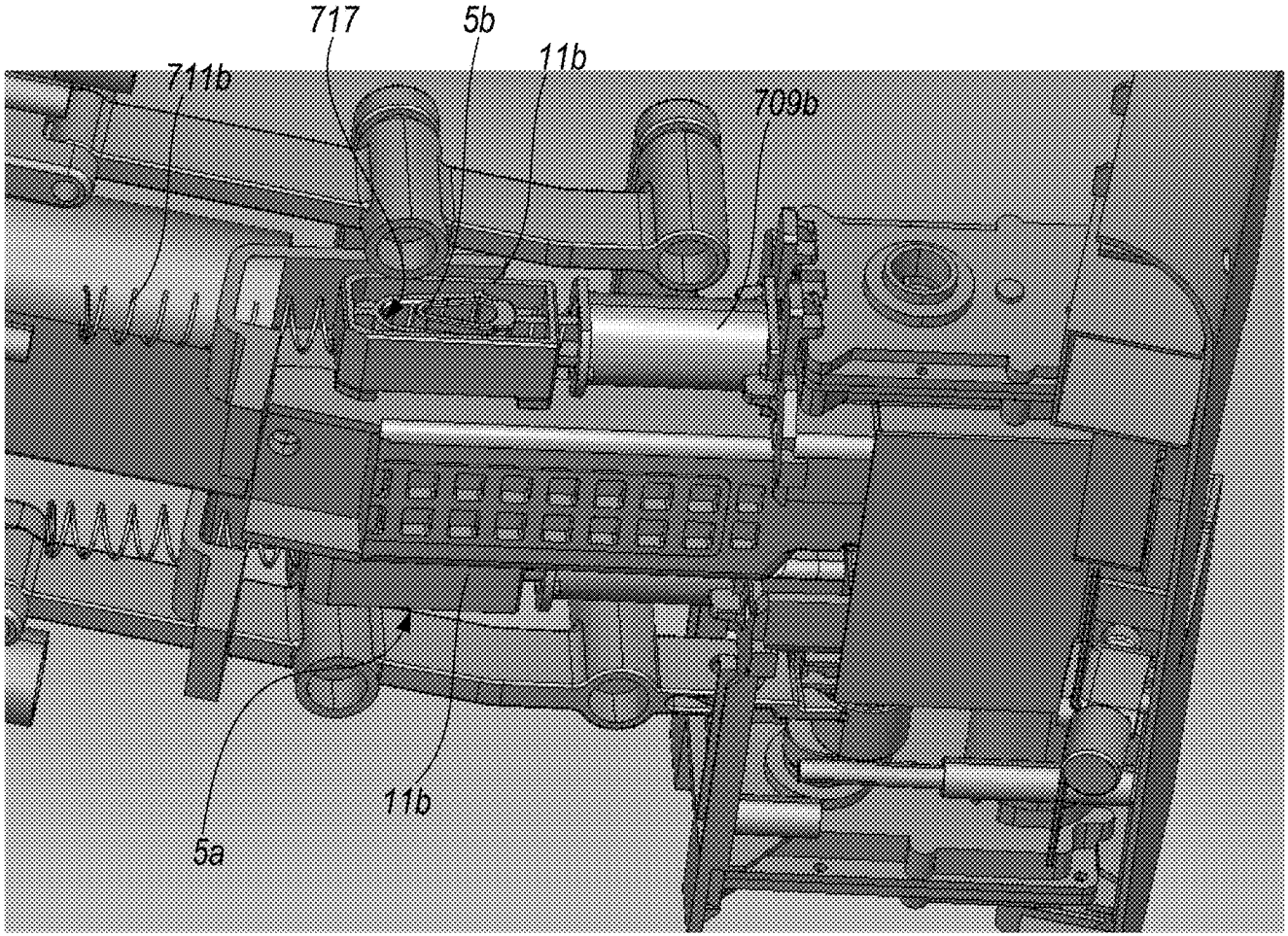
FIG. 9 is an isometric view illustrating components of an apparatus configured in accordance with representative embodiments of the disclosed technology.

FIG. 9 is an isometric view illustrating components of the apparatus 700 configured in accordance with representative embodiments of the disclosed technology. As shown in FIG. 9, the first rod assembly 6 includes a second protrusion 5*b* positioned in the second guiding element 11*b*. As shown, the internal surface of the second guiding element 11*b* forms a curved contact surface 717 configured to guide and/or limit the movement of the second protrusion 5*b*. Similarly, the first rod assembly 6 can include a first protrusion 5*a* (see FIG. 1) configured to be positioned in the first guiding element 11*a*. The first guiding element 11*a* can have a curved internal surface similar to the features of the second guiding element 11*b* described above. In some embodiments, the first guiding element 11*a* and the second guiding element 11*b* can have different shapes.

Figure 10:
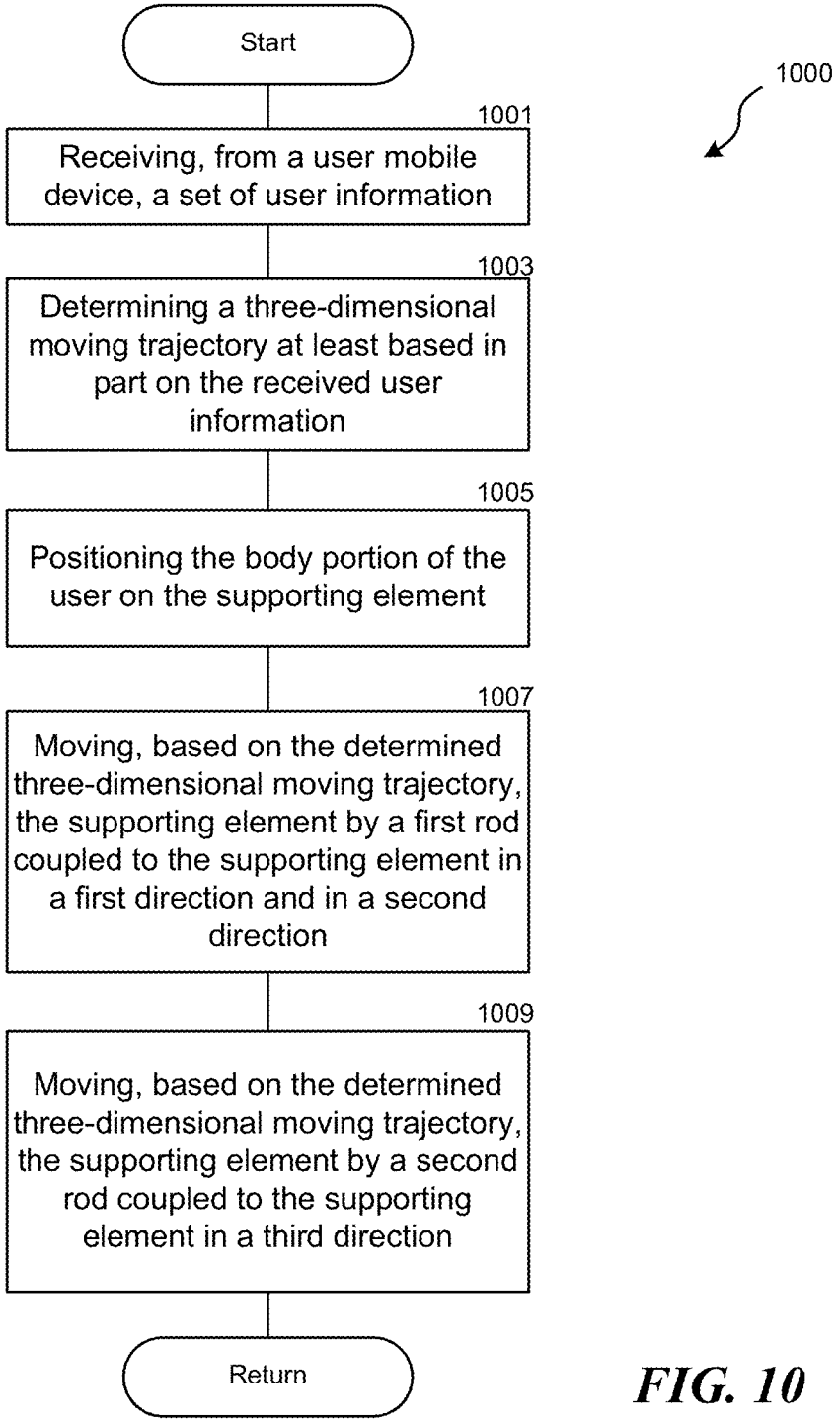
FIG. 10 is a flowchart illustrating a method in accordance with representative embodiments of the disclosed technology.

FIG. 10 is a flowchart illustrating a method 1000 in accordance with representative embodiments of the disclosed technology. The method 1000 can be implemented by the apparatuses (e.g., the apparatus 100 or 700) in accordance with the present technology. The method 1000 can effectively move a supporting element along a three-dimensional moving trajectory. The supporting element is configured to support a body portion of a user. At block 1001, the method 1000 starts by receiving, from a user mobile device, a set of user information. In some embodiments, the user information includes information associated with the physical condition of the user and/or information regarding the user's desirable movements for the body portion. In some embodiments, the user information can be received from a remote database or a storage device within the user mobile device.

At block 1003, the method 1000 continues by determining the three-dimensional moving trajectory at least based in part on the received user information. In some embodiments, the three-dimensional moving trajectory can be determined or calculated based by an analysis component (e.g., an application implemented by a processor) of the user mobile device. In some embodiments, the three-dimensional moving trajectory can be selected from a plurality of candidate trajectories based on the received user information.

At block 1005, the method 1000 includes positioning the body portion of the user on the supporting element. At block 1007, the supporting element is moved, along the determined three-dimensional moving trajectory, by a first rod coupled to the supporting element in a first direction and in a second direction. The first direction and the second direction together define a reference plane (e.g., the reference plane 105). The supporting element is also moved, along the determined three-dimensional moving trajectory, by a second rod coupled to the supporting element, at least partially, in a third direction. The third direction is generally perpendicular to the reference plane (e.g., FIG. 1). The movements of the first rod and the second rod can be simultaneous, alternating or otherwise sequenced, randomized, dependent or independent from each other. In some embodiments, the first rod is coupled to a first motor via a first crankshaft, and the second rod is coupled to a second motor via a second crankshaft. In some embodiments, the second rod includes a first linking member operably coupled to the second crankshaft and a second linking member operably coupled to the first linking member. In some embodiments, the second linking member can be operably coupled to the first rod. By moving the first rod and the second rod in the first, second and third directions, the supporting element can be moved along the determined three-dimensional moving trajectory. The method 1000 then returns and waits for further instructions.

From the foregoing, it will be appreciated that specific embodiments of the technology have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall with within the scope of the present technology. Accordingly, the present disclosure and associated technology can encompass other embodiments not expressly shown or described herein.

At least some portion of the technology introduced herein can be implemented by, for example, programmable circuitry (e.g., one or more microprocessors) programmed with software and/or firmware, or entirely in special-purpose hardwired circuitry, or in a combination of such forms. Special-purpose hardwired circuitry may be in the form of, for example, one or more application-specific integrated circuits (ASICs), programmable logic devices (PLDs), field-programmable gate arrays (FPGAs), etc.

Software or firmware for use in implementing at least some portion of the technology introduced here may be stored on a machine-readable storage medium and may be executed by one or more general-purpose or special-purpose programmable microprocessors. A "machine-readable storage medium," as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible storage medium includes recordable/non-recordable media (e.g., read-only memory (ROM); random access memory (RAM); magnetic disk storage media; optical storage media; flash memory devices; etc.), etc.

The term "logic," as used herein, can include, for example, programmable circuitry programmed with specific software and/or firmware, special-purpose hardwired circuitry, or a combination thereof.

Some embodiments of the disclosure have other aspects, elements, features, and steps in addition to or in place of what is described above. These potential additions and replacements are described throughout the rest of the specification. Reference in this specification to "various embodiments," "certain embodiments," or "some embodiments" means that a particular feature, structure, or characteristic described in connection with the embodiment is included in at least one embodiment of the disclosure. These embodiments, even alternative embodiments (e.g., referenced as "other embodiments") are not mutually exclusive of other embodiments. Moreover, various features are described which may be exhibited by some embodiments and not by others. Similarly, various requirements are described which may be requirements for some embodiments but not other embodiments.

To the extent any materials incorporated herein conflict with the present disclosure, the present disclosure controls.

We claim:

1. An apparatus for moving a body portion of a user, the apparatus comprising:

a supporting element configured to support the body portion;

a first rod configured to selectively move the supporting element in a first direction and in a second direction, wherein the first direction and the second direction together define a reference plane;

a first shaft coupled to the first rod;

a first speed reducer coupled to and configured to rotate the first shaft so as to facilitate moving the first rod in the first and second directions;

a first motor coupled to the first speed reducer and configured to rotate the first shaft;

a second rod configured to selectively move the supporting element in a third direction, wherein the third direction is generally perpendicular to the reference plane;

a second shaft coupled to the second rod;

a second speed reducer coupled to and configured to rotate the second shaft so as to facilitate moving the second rod in the third direction; and a second motor coupled to the second speed reducer and configured to rotate the second shaft;

wherein the supporting element is moved in the first, second and third directions by the first and second rods along a three-dimensional moving trajectory.

2. The apparatus of claim 1, wherein the second rod further includes a first linking member operably coupled to the second shaft and a second linking member operably coupled to the first linking member.

3. The apparatus of claim 2, wherein the first linking member is operably coupled to the first rod, and wherein the first linking member has an L-shape.

4. The apparatus of claim 2, wherein the second linking member is coupled to the supporting member.

5. The apparatus of claim 2, wherein the second rod further includes a third linking member operably coupled to the second linking member, and wherein the third linking member is operably coupled to the first rod.

6. The apparatus of claim 5, wherein the third linking member is positioned parallel to a portion of the first linking member.

7. The apparatus of claim 5, wherein the second rod further includes a fourth linking member operably coupled to the third linking member and the first linking member.

8. The apparatus of claim 7, wherein the fourth linking member is positioned parallel to the second linking member.

9. The apparatus of claim 1, further comprising a chassis coupled to the first motor and the second motor, and wherein the chassis is configured to be positioned on a floor surface generally parallel to the reference surface.

10. The apparatus of claim 1, wherein the first rod includes a first protrusion and a second protrusion positioned opposite to the first protrusion, wherein the first protrusion is configured to be positioned in a first guiding element and the second protrusion is configured to be positioned in a second guiding element, and wherein the first guiding element and the second guiding element together define a range that the first rod moves in.

11. The apparatus of claim 10, further comprising a chassis operably coupled to the first guiding element and the second guiding element.

12. The apparatus of claim 11, wherein a first distance between the first guiding element and the chassis is adjustable by a first adjusting component, and wherein a second distance between the second guiding element and the chassis is adjustable by a second adjusting component.

13. The apparatus of claim 12, wherein the first adjusting component includes a first hydraulic piston positioned between the first guiding element and the chassis, and wherein the second adjusting component includes a second hydraulic piston positioned between the second guiding element and the chassis.

14. The apparatus of claim 1, further comprising a chassis coupled to the first motor and the second motor, and wherein the chassis is configured to be positioned on a floor surface.

15. The apparatus of claim 1, further comprising a chassis coupled to the first speed reducer and the second speed reducer, and wherein the chassis is configured to be positioned on a floor surface.

16. The apparatus of claim 1, wherein a two-dimensional moving trajectory of the supporting element is on the reference plane, and wherein a projection of the three-dimensional moving trajectory along the third direction on the reference plane includes the two-dimensional moving trajectory.

17. The apparatus of claim 1, further comprising a controller coupled to the first and second motors and configured to instruct the first motor to operate in a first speed and to instruct the second motor to operate at a second speed.

18. A method for moving a supporting element along a three-dimensional moving trajectory, the supporting element being configured to support a body portion of a user, the method comprising:

receiving a set of user information;

determining the three-dimensional moving trajectory at least based in part on the received user information;

moving the supporting element, by a first rod coupled to the supporting element, in a first direction and in a second direction based on the determined three-dimensional moving trajectory, wherein the first direction and the second direction together define a reference plane; and moving the supporting element, by a second rod coupled to the supporting element, in a third direction based on the determined three-dimensional moving trajectory, wherein the third direction is generally perpendicular to the reference plane;

wherein the first rod is coupled to a first motor via a first shaft;

wherein the second rod is coupled to a second motor via a second shaft;

wherein the second rod includes a first linking member operably coupled to the second shaft and a second linking member operably coupled to the first linking member; and wherein the second linking member is operably coupled to the first rod.

19. The method of claim 18, wherein the second rod includes a third linking member operably coupled to the second linking member, and wherein the second rod includes a fourth linking member operably coupled to the third linking member, and wherein the fourth linking member is operably coupled to the first linking member, and wherein the fourth linking member is positioned parallel to the second linking member, and wherein the third linking member is positioned parallel to the first linking member.

20. A system for moving a body portion of a user, comprising:

a processor;

a memory coupled to the processor;

a data storage coupled to the processor and configured to store information associated with a plurality of three dimensional candidate trajectories corresponding to a plurality of treatments for the user;

a user interface coupled to the processor and configured to receive user information, wherein the processor determines, based on the user information, a three-dimensional moving trajectory from the stored plurality of three dimensional candidate trajectories;

a supporting element configured to support the body portion;

a first rod configured to selectively move the supporting element in a first direction and in a second direction, wherein the first direction and the second direction together define a reference plane;

a first shaft coupled to the first rod;

a first motor coupled and configured to rotate the first shaft;

a second rod configured to selectively move the supporting element in a third direction, wherein the third direction is generally perpendicular to the reference plane;

a second shaft coupled to the second rod; and a second motor coupled and configured to rotate the second shaft;

wherein the supporting element is moved in the first, second and third directions by the first and second rods along the three-dimensional moving trajectory.

* * * * *